US006109998A

United States Patent [19]

DiResta et al.

[11] Patent Number: 6,109,998

[45] **Date of Patent: *Aug. 29, 2000**

[54] SQUEEZABLE PLAYTHING RESEMBLING ANIMAL-LIKE OR HUMANOID FIGURE

[76] Inventors: Joseph G. DiResta; James DiResta, both of 1078 W. Broadway, Woodmere, N.Y. 11598

[ * ] Notice: This patent is subject to a terminal disclaimer.

[21] Appl. No.: 09/094,875

[22] Filed: Jun. 15, 1998

Related U.S. Application Data

[63] Continuation-in-part of application No. 08/714,417, Sep. 16, 1996, Pat. No. 5,769,682, which is a continuation-in-part of application No. 08/543,615, Oct. 16, 1995, Pat. No. 5,577,723.

[51] Int. Cl.[7] ..... A63H 3/28; A63H 3/52; A63H 5/00

[52] U.S. Cl. ..... 446/184; 446/267; 446/397; 473/609

[58] Field of Search ..... 446/180, 184, 446/183, 188, 267, 190, 193, 196, 199, 321, 368, 397, 490, 491; 473/571, 594, 609

[56] References Cited

U.S. PATENT DOCUMENTS

| | | | |
|---|---|---|---|
| 4,040,619 | 8/1977 | Landi | 446/490 X |
| 4,623,319 | 11/1986 | Zaruba et al. | 446/267 X |
| 4,781,645 | 11/1988 | Kato | 446/188 |
| 4,881,915 | 11/1989 | Liaw | 446/368 X |
| 4,952,190 | 8/1990 | Tarnoff et al. | 446/267 |
| 4,986,540 | 1/1991 | Leslie | 446/267 X |
| 4,990,119 | 2/1991 | Amici et al. | 446/188 X |
| 5,338,245 | 8/1994 | Murza et al. | 446/267 |
| 5,462,273 | 10/1995 | Spector | 473/594 |
| 5,577,723 | 11/1996 | DiResta et al. | 446/267 X |
| 5,769,682 | 6/1998 | DiResta et al. | 446/184 |
| 5,846,116 | 12/1998 | DiResta et al. | 446/184 |

FOREIGN PATENT DOCUMENTS

| | | | |
|---|---|---|---|
| 1603355 | 5/1970 | Germany | 446/188 |
| 2215226 | 9/1989 | United Kingdom | 446/368 |

*Primary Examiner*—D Neal Muir
*Attorney, Agent, or Firm*—Michael Ebert

[57] ABSTRACT

A squeezable plaything which resembles an animal-like or humanoid figure having appendages projecting therefrom. The plaything includes a hollow core molded of resilient plastic material shaped to resemble the figure and provided with an orifice which renders the core collapsible. Enveloping the core and generally conforming to the figure and its appendages is an outer shell formed of flexible transparent plastic film material. Injected into the core through the orifice is a charge of oil which when the plaything is squeezed and deformed, oil and air are then discharged through the orifice into confined spaces between the shell and the core. And when the plaything is released to recover its shape, the oil and air are then sucked back through the orifice into the core. These actions generate squishing sounds, as if the figure were walking on soft mud.

10 Claims, 2 Drawing Sheets

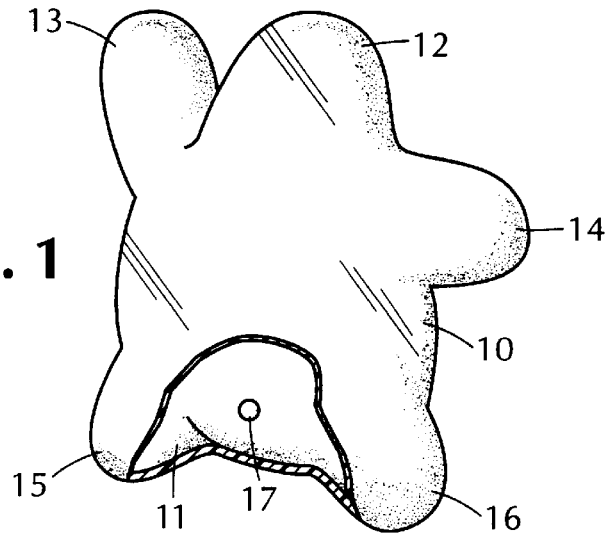
FIG. 1
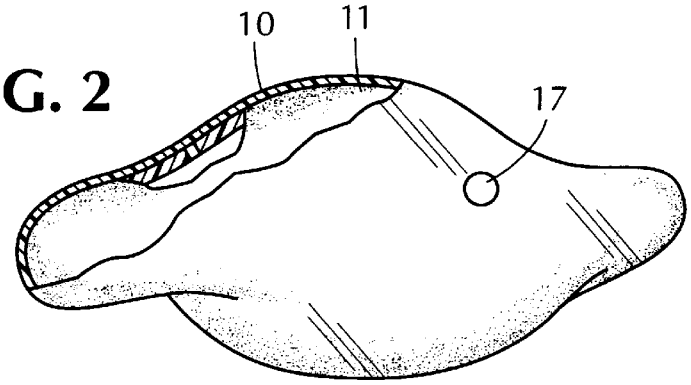
FIG. 2
FIG. 3
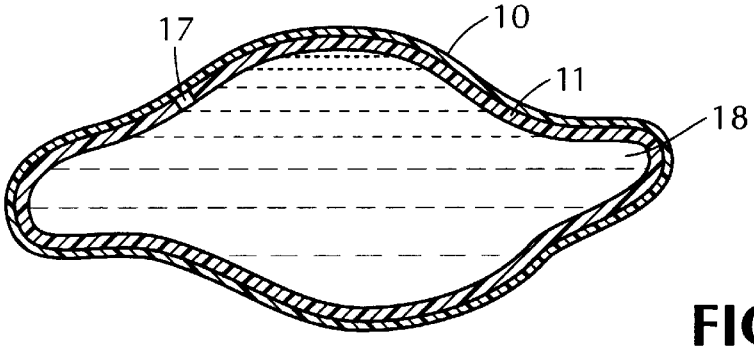
FIG. 4
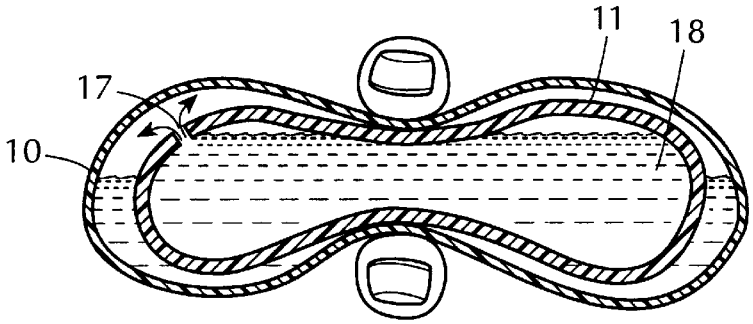

FIG. 5
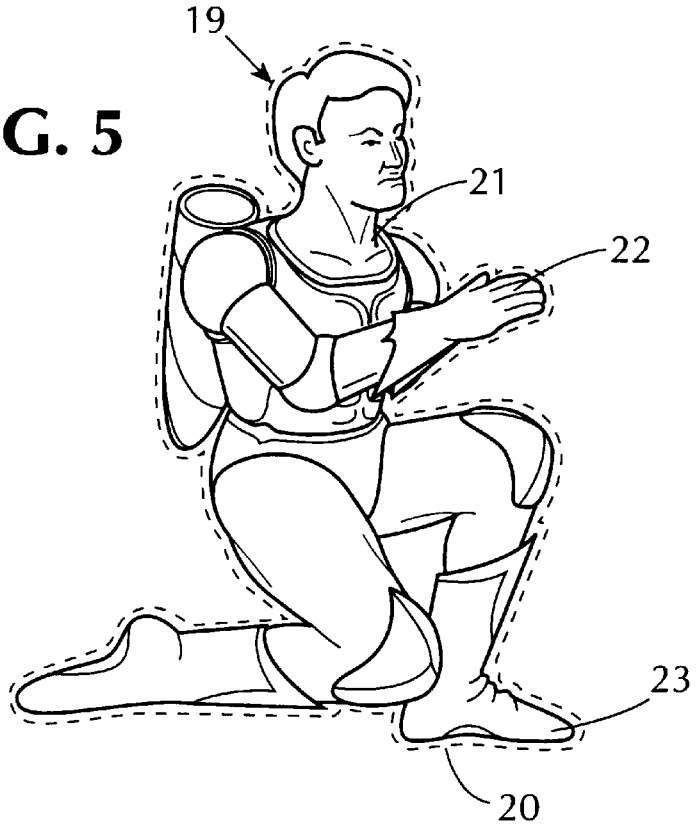
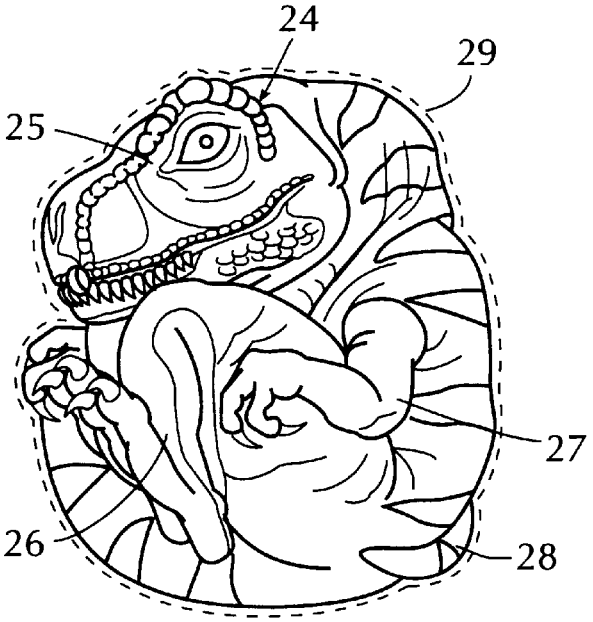
FIG. 6

SQUEEZABLE PLAYTHING RESEMBLING ANIMAL-LIKE OR HUMANOID FIGURE

RELATED APPLICATIONS

This application is a continuation-in-part of the copending DiResta application Ser. No. 08/714,417, filed Sep. 16, 1996 titled "Squeezable Toy Plaything" now U.S. Pat. No. 5,769,682 which in turn is a C-I-P of application Ser. No. 08/543,615, filed Oct. 16, 1995 titled "Squeezable Toy Ball" (now U.S. Pat. No. 5,577,723). The entire disclosure of these earlier applications is incorporated herein by reference.

BACKGROUND OF INVENTION

1. Field of Invention

This invention relates generally to squeezable toy playthings, and more particularly to a plaything that resembles an animal-like or humanoid figure having appendages which when the plaything is squeezed, produces squishing sounds, as if the figure were walking on soft mud.

2. Status of Prior Art

The concern of this invention is a squeezable plaything that looks like an animal-like or humanoid figure. In our above-identified copending application Ser. No. 08/714,414, a squeezable plaything is disclosed which has a ball-like form composed of a hollow inner core whose outer surface is contoured to simulate a humanoid figure, the core being encased in a transparent shell.

When this ball is squeezed, a charge of oil and air within the hollow core is then discharged through an orifice in the core to produce a gurgling sound. But in this plaything, while the core resembles a humanoid figure, it has no projections which form appendages simulating the arms and legs of the figure, an essential feature of the present invention.

It is known to provide toy balls having a humanoid form. Thus the Tarnoff U.S. Pat. No. 4,952,190 shows a toy formed from a molded flexible bladder having a humanoid shape, the bladder being filled with a mixture of plastic microspheres and water so that the toy can be thrown or hit, yet can be caught with the bare hand. The rubber ball disclosed in the Johns U.S. Pat. No. 2,960,794 is molded to include pop out parts which when the ball is squeezed, pop out to create facial features, such as a nose and ears.

The patents of Osher et al. U.S. Pat. No. 5,026,054 and 4,944,363 disclose squeezable toy balls having a flexible polymer shell encasing a resiliently deformable inner core of highly plasticized material. Because of the highly plasticized nature of the polymeric core, the toy ball has a soft and supple resilient feeling to one who holds and squeezes it. According to these patents, the feel of the ball is both intriguing and relaxing.

The patent to Hoover U.S. Pat. No. 2,351,762 discloses a toy having a transparent outer plastic shell enclosing an inner hollow core formed as a plurality of body parts. The British patent 743,653 to Dahs shows a hollow toy figure having an orifice which creates a sound when the figure is squeezed.

Also of prior art interest is the tearing eye doll disclosed in the Ostrander U.S. Pat. No. 3,822,500 which is actuated by squeezing the torso of the doll.

SUMMARY OF INVENTION

In view of the foregoing, the main object of this invention is to provide a squeezable plaything resembling an animal-like or humanoid figure which when manually squeezed and deformed by a player and then released to recover its normal shape, generates squishing sounds.

To squish is to emit a gurgling or sucking sound comparable to sounds produced when walking on soft mud. In our above-identified U.S. Pat. No. 5,577,723, a squeezable ball which resembles an intestine, produces when squeezed a gurgling sound suggesting intestinal activity. In the context of the present invention, the squeezable plaything resembles an animal-like or humanoid figure, and the squishing sounds produced thereby suggests sounds produced when the figure is walking on soft mud.

More particularly, an object of this invention is to provide a plaything created by an inner core formed of resilient plastic material molded to resemble the figure and its natural appendages, and a shell of transparent plastic film enveloping the figure and the appendages and conforming thereto.

Also an object of the invention is to provide a plaything of the above type which is durable and capable of withstanding rough treatment by a player.

Briefly stated, these objects are attained by a squeezable plaything which resembles an animal-like or humanoid figure having appendages projecting therefrom. The plaything includes a hollow core molded of resilient plastic material shaped to resemble the figure and its appendages and provided with an orifice which renders the core collapsible. Enveloping the core and generally conforming to the figure and its appendages is an outer shell formed of flexible transparent plastic film material.

Injected into the core through the orifice is a charge of oil. When the plaything is squeezed and deformed, oil and air are then discharged through the orifice into confined spaces between the shell and the core. And when the plaything is released to recover its shape, the oil and air are then sucked back through the orifice into the core. These actions generate squishing sounds, as if the figure were walking on wet mud.

BRIEF DESCRIPTION OF DRAWING

For a better understanding of the invention reference is made to the detailed description to follow which is to be read in conjunction with the accompanying drawings in which:

FIG. 1 is a perspective view of a first embodiment of squeezable plaything in accordance with the invention which resembles a sea turtle;

FIG. 2 is a side view of the plaything, the outer shell being cut away to expose a portion of the inner core having an orifice therein;

FIG. 3 is a sectional view of the portion of the inner core shown in FIG. 2 in which there is contained a charge of oil;

FIG. 4 shows the plaything being squeezed to discharge air and oil out the orifice in the inner core;

FIG. 5 as a perspective view of a second embodiment of the invention which resembles an aborigine; and FIG. 6 is a perspective view o a third embodiment which resembles a dinosaur.

DESCRIPTION OF INVENTION

First Embodiment

Referring now to FIGS. 1 to 3, there is shown a squeezable plaything in accordance with the invention formed by an outer shell 10 enveloping a collapsible inner core 11.

Inner core 11 which is hollow and air filled is molded of resilient synthetic plastic material, such as PVC or polyurethane to simulate the appearance of an animal-like figure. In the example illustrated, the figure has a form similar to that of a sea turtle having a head 12, forwardly-projecting front paws 13 and 14 and rearwardly projecting rear paws 15 and 16. Formed in the rear region of the core is an orifice 17 which renders the air-filled hollow core collapsible, for when the core is squeezed, air therein is expelled through the orifice. Thus paws 13, 14, 15 and 16 are created by appendages projecting from the body of the figure.

Outer shell 10 formed of transparent, flexible film of synthetic plastic material, such as polypropylene or polyethylene, the shell being hermetically sealed and impermeable to fluids. The shell envelopes the figure-like core and generally conforms to the figure and its appendages. However, the shell does not tightly conform to the core, hence there are confined narrow air spaces therebetween.

Injected into hollow core 11 through orifice 17, as shown in FIG. 3, is a charge 18 of an inert, viscous fluid, such as silicone or mineral oil. When therefore the plaything is squeezed and deformed, as shown in FIG. 4, the resultant internal pressure causes a stream of oil and air to be discharged through orifice 17 into the confined spaces between the core and the shell conforming thereto.

When the plaything is then released to recover its normal shape, a negative pressure is produced in the hollow core from which air and oil had been expelled, this negative pressure acting to suck back the air and oil into the core. Thus when the plaything is in its normal state, there is no oil visible to an observer.

The vigorous discharge of an air and oil stream from the hollow core followed by the sucking back of the oil and air into the core produces audible squishing sounds suggestive of sounds that would be produced had an actual full scale animal having four paws similar to those of the illustrated figure been walking on soft mud or other liquid saturated soft material.

The animal-like figure shown in the drawing is by way of example only, for in practice the shape of the figure and the appendages projecting therefrom may resemble a tiger which in addition to four paws has a tail appendage, or any fanciful or mythical figure, such as a dragon or dinosaur. And instead of an animal-like figure, a humanoid figure may be provided whose forwardly projecting arms and whose rearwardly projecting legs define the appendages, the orifice then being in the buttocks of the figure.

Other Embodiments

In the second and third embodiments shown in FIGS. 5 and 6, the structure of these embodiments is essentially the same as in the first embodiment.

Thus in the second embodiment shown in FIG. 5, the squeezable plaything includes a hollow core 19 molded of resilient plastic material provided with an orifice, and a shell 20 enveloping the core formed of flexible transparent plastic film material, the shell being represented by dashed lines.

However, in FIG. 5, core 11 is molded to resemble an aborigine having a head 21, arm appendages 22 extending from the shoulders of this figure, and leg appendages extending from the lower end of the torso. A quiver 24 storing arrows is strapped to the back of the figure.

Shell 20 generally conforms to the contours of the head, body and appendages of the aborigine to create confined spaces between the contours of the core and the contours of the shell.

A charge of an inert viscous fluid is injected into core 19 through its orifice (not shown in FIG. 5). When therefore the plaything which resembles an aborigine is squeezed and deformed, a stream of air and fluid is discharged through the orifice (as in FIG. 1) into the confined spaces between the contoured core and its conforming shell. When the plaything is released and recovers its normal shape, air and oil are then sucked back into the core through the orifice, these actions generating squishing sounds.

In the embodiment of the plaything shown in FIG. 6, the core 24 is molded to resemble a dinosaur having a massive head, forelegs 26 rear legs 27 and a tail 28. The dinosaur is in a hunched or crouched posture, with its appendages retracted. The dinosaur-like core 24 is enveloped in a transparent plastic shell 28 indicated by dashed lines, which conform to the contours of the core.

The plaything shown in FIG. 6 has an orifice in its hollow core and a charge of a viscous fluid injected through the orifice into the core, this plaything when squeezed and released producing as in the case of the embodiment shown in FIG. 5 a squishing sound.

While there has been disclosed preferred embodiments of squeezable plaything resembling an animal-like or humanoid figure in accordance with the invention, it will be appreciated that many changes may be made therein without departing from the spirit of the invention. Thus in practice the oil injected into the core may have a color distinctly different from the color of the core to produce a visual effect accompanying the squishing sounds.

We claim:

1. A squeezable plaything comprising:

A. an air-filled hollow core molded of resilient plastic material shaped to resemble an animal-like or humanoid figure having appendages projecting therefrom, said core being provided with an orifice which renders the core collapsible;

B. a shell formed of flexible transparent plastic material enveloping the core and its appendages and generally conforming thereto to create confined spaces between the core and the shell; and C. a charge of an inert viscous fluid injected into the core through the orifice whereby when the plaything is squeezed and deformed, a stream of air and fluid is discharged through said orifice into said confined spaces, and when the plaything is released to recover its normal shape, air and fluid are then sucked back into the core through the orifice, these actions generating squishing sounds.

2. A plaything as set forth in claim 1, in which the figure has a pair of forwardly projecting front paws and a pair of rearwardly projecting rear paws.

3. A plaything as set forth in claim 1, in which the figure has arm and leg appendages.

4. A plaything as set forth in claim 1, in which said core is formed of polyurethane.

5. A plaything as set forth in claim 1, in which said shell is formed of polyethylene.

6. A plaything as set forth in claim 1, in which said viscous fluid is a mineral oil.

7. A plaything as set forth in claim 5, in which said oil has a distinctive color.

8. A plaything as set forth in claim 1, in which the figure resembles a sea turtle.

9. A plaything as set forth in claim 1, in which the figure resembles a dinosaur.

10. A plaything as set forth in claim 1, in which the figure resembles an aboriginal.

* * * * *